US008355523B2

(12) United States Patent
Funahashi

(10) Patent No.: US 8,355,523 B2
(45) **Date of Patent: *Jan. 15, 2013**

(54) SPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 1329 days.

This patent is subject to a terminal disclaimer.

(21) Appl. No.: 11/573,558

(22) PCT Filed: Sep. 12, 2006

(86) PCT No.: PCT/JP2006/318014

§ 371 (c)(1),
(2), (4) Date: Feb. 12, 2007

(87) PCT Pub. No.: WO2007/037115

PCT Pub. Date: Apr. 5, 2007

(65) Prior Publication Data

US 2012/0263339 A1 Oct. 18, 2012

(30) Foreign Application Priority Data

Sep. 27, 2005 (JP) ..... 2005-279703

(51) Int. Cl.
*H04R 25/00* (2006.01)

(52) U.S. Cl. ..... 381/404; 381/396; 381/398

(58) Field of Classification Search ..... 381/396, 381/398, 400–401, 404, 411, 423–424
See application file for complete search history.

(56) References Cited

U.S. PATENT DOCUMENTS

| | | | | |
|---|---|---|---|---|
| 6,735,323 | B1 * | 5/2004 | Chang | 381/404 |
| 7,171,015 | B2 | 1/2007 | Murayama et al. | |
| 7,209,570 | B2 | 4/2007 | Funahashi et al. | |
| 7,292,707 | B2 * | 11/2007 | Kreitmeier et al. | 381/398 |
| 2005/0008188 | A1 * | 1/2005 | Harris | 381/404 |
| 2005/0175212 | A1 | 8/2005 | Murayama et al. | |

FOREIGN PATENT DOCUMENTS

| | | | |
|---|---|---|---|
| CN | 1652635 | A | 8/2005 |
| JP | 35-2305 | Y | 2/1960 |

(Continued)

OTHER PUBLICATIONS

Japanese Office Action dated Apr. 20, 2010.

(Continued)

*Primary Examiner* — Suhan Ni
(74) *Attorney, Agent, or Firm* — Pearne & Gordon LLP

(57) ABSTRACT

A damper, which is an element of a speaker and suppresses the rolling of a voice coil unit, includes a corrugated structure portion at its inner periphery and a leaf spring at its outer periphery. By coupling the corrugated structure portion to the voice coil unit and coupling the leaf spring to the frame, the distortion of a speaker can be reduced and the driving efficiency can be improved.

13 Claims, 2 Drawing Sheets

FOREIGN PATENT DOCUMENTS

| | | | |
|---|---|---|---|
| JP | 45-33465 | | 10/1970 |
| JP | 52-23968 | Y | 5/1977 |
| JP | 62-191295 | U | 12/1987 |
| JP | 63-78496 | | 5/1988 |
| JP | 2-133097 | | 11/1990 |
| JP | 2-133097 | U | 11/1990 |
| JP | 02-133097 | U | 11/1990 |
| JP | 2003-199192 | | 7/2003 |
| JP | 2004-007332 | | 1/2004 |
| KR | 10-0500804 | | 4/2005 |

OTHER PUBLICATIONS

Chinese Office action dated Jan. 26, 2011.

Supplementary European Search Report for PCT/JP2006-318014 dated Apr. 21, 2011.

South Korean Office Action.

Korean Office Action.

* cited by examiner

SPEAKER

TECHNICAL FIELD

The present invention relates to a speaker.

BACKGROUND ART

Japanese Patent Unexamined Publication No. 2004-7332 discloses a speaker shown in FIG. 3 in which voice coil unit 2 that is movably disposed on magnetic circuit 1 is coupled to the inner peripheral end of diaphragm 3 and the outer peripheral end of diaphragm 3 is coupled to frame 5 via edge 4. In this speaker, the rear surface of diaphragm 3 is coupled to frame 5 via suspension holder 6 and edge 7. Furthermore, edges 4 and 7 are allowed to protrude in the opposite directions to each other, thereby allowing the vertical amplitude to be vertically symmetric. Thus, the distortion of the speaker is reduced.

However, when such a speaker structure is employed, suspension holder 6 is formed so as to have at least the same level of rigidity as that of diaphragm 3. This causes the driving load of magnetic circuit 1 to increase. As a result, it is difficult to improve the driving efficiency of a speaker.

SUMMARY OF THE INVENTION

A speaker includes a frame, a magnetic circuit, a voice coil unit, a diaphragm, and a damper. The magnetic circuit is supported by the frame. The voice coil unit is inserted into a magnetic gap provided in the magnetic circuit and can move in the magnetic gap. The diaphragm is coupled to the frame via an edge at its outer peripheral end and coupled to the voice coil unit at its inner peripheral end. The damper is provided at a part that is lower than the diaphragm and nearer to the magnetic circuit and coupled to the frame at its outer peripheral end and to the voice coil unit at its inner peripheral end. The damper includes a corrugated structure portion at its inner peripheral side and a leaf spring at its outer peripheral side.

With such a configuration, the distortion of the speaker can be suppressed and the driving efficiency can be improved.

REFERENCE MARKS IN THE DRAWINGS

Figure 1A:
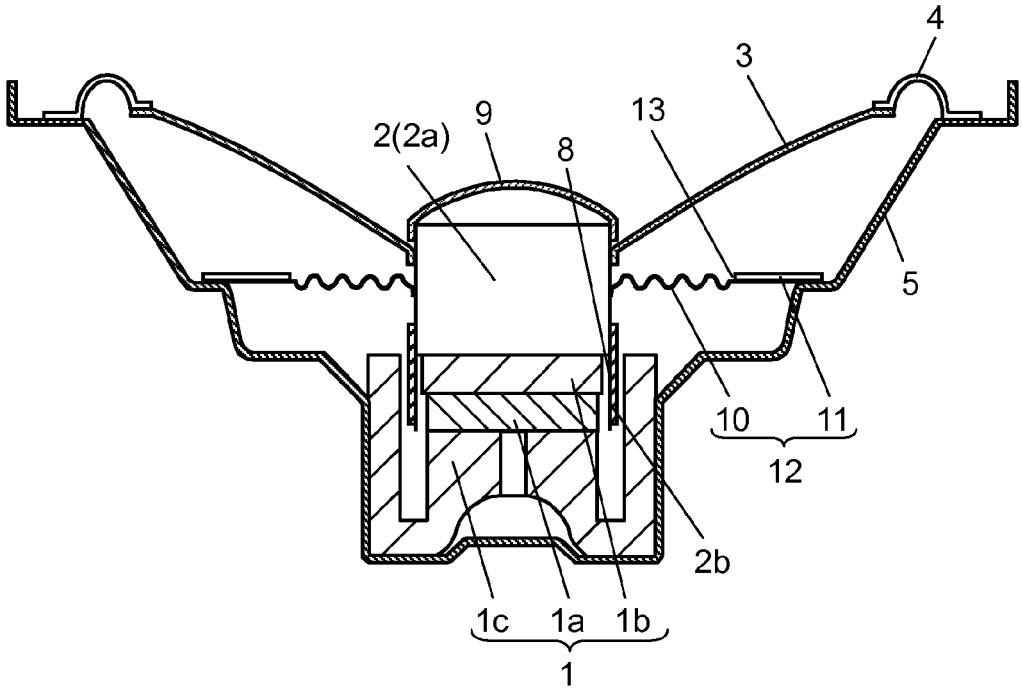
FIG. 1A is a sectional view showing a speaker in accordance with a first exemplary embodiment of the present invention.

1 magnetic circuit
2 voice coil unit

3 diaphragm
4 edge
5 frame
8 magnetic gap
10 corrugated structure portion
11 leaf spring
12 damper
13 coupling portion
14 linearly extending portion

DETAILED DESCRIPTION OF THE PREFERRED EMBODIMENTS

First Exemplary Embodiment

Hereinafter, a first exemplary embodiment of the present invention is described with reference to drawings. In the description, the same reference numerals are given to the same configurations as those mentioned above as a background art.

FIG. 1A is a sectional view showing a speaker in accordance with a first exemplary embodiment of the present invention. Magnetic circuit 1 disposed in the middle of the bottom of bowl-shaped frame 5 is constructed by combining and bonding disk-shaped magnet 1*a*, disk-shaped plate 1*b* and cylindrical yoke 1*c*. Magnetic gap 8 opening upward in magnetic circuit 1 is formed between the inner peripheral side surface of the side wall of yoke 1*c* and the outer peripheral side surface of disk-shaped plate 1*b*.

Furthermore, voice coil unit 2 (hereinafter, referred to as coil unit 2) has a structure in which coil 2*b* is wound around the outer periphery of cylindrical main body 2*a*. In the structure, coil unit 2 is inserted into magnetic gap 8 and moves in the magnetic gap in the vertical direction, which vibrates diaphragm 3 coupled to the upper outer periphery of coil unit 2. On the upper end of coil unit 2, dust cap 9 is provided in order to prevent dust from entering.

Diaphragm 3 is a sound generation source of a speaker and includes, as a main material, pulp and resin having both high rigidity and internal loss. Diaphragm 3 is coupled to an open end of frame 5 via edge 4 protruding upward at its outer peripheral end and fixed to coil unit 2 at its inner peripheral end. Edge 4 is formed of a material such as urethane, foamed rubber, SBR rubber, and cloth in order to minimize the moving load applied to diaphragm 3.

Damper 12 includes corrugated structure portion 10 at its inner periphery and leaf spring (or plate spring) 11 at its outer periphery. Corrugated structure portion 10 and leaf spring 11 are coupled together by coupling portion 13 having a predetermined region. The inner peripheral end of corrugated structure portion 10 is coupled to a part that is lower than a part where diaphragm 3 is fixed to coil unit 2 and nearer to magnetic circuit 1. To the outer peripheral end of corrugated structure portion 10, leaf spring 11 is fixed as a separate body. The outer periphery of leaf spring 11 is coupled to frame 5. Corrugated structure portion 10 is formed in a corrugated sheet and has a ring structure surrounding coil unit 2. In this structure, corrugated structure portion expands and contracts in accordance with the movement of coil unit 2. Furthermore, similar to edge 4 provided on diaphragm 3, corrugated structure portion 10 is formed of a material such as urethane, foamed rubber, SBR rubber and cloth in order to minimize the moving load applied to diaphragm 3.

When a sound signal is applied to coil 2*b* of coil unit 2, coil unit 2 responds to a magnetic field in magnetic gap 8 and moves in the vertical direction. Due to this movement, diaphragm 3 vibrates and sound is output from a speaker. In particular, since leaf spring 11 is provided on the outer peripheral end of corrugated structure portion 10, the distortion of the speaker is suppressed. In addition, the driving efficiency of the speaker is enhanced.

Originally, damper 12 is coupled to frame 5 and coil unit 2 at its both ends respectively and suppresses the rolling occurring at the time when coil unit 2 moves. In order that damper 12 can easily follow the movement of coil unit 2, damper 12 has corrugated structure portion 10 formed in a corrugated sheet, providing elasticity and suppressing the rolling. The rolling refers to as a phenomenon in which force acting on coil unit 2 becomes asymmetric for some reasons, so that coil unit 2 vibrates in the lateral direction not in the vertical direction which is original movable direction.

In the case where corrugated structure portion 10 formed in a corrugated sheet is provided, when the amount of amplitude of coil unit 2 is small, large load may not be applied by the movement of coil unit 2. However, when the amount of amplitude of coil unit 2 becomes larger than a predetermined amount, the load becomes large rapidly.

Then, in this exemplary embodiment, the outer periphery of corrugated structure portion 10 is coupled to frame 5 via leaf spring 11. Thus, the movable range of coil unit 2 is increased. When corrugated structure portion 10 is loaded, stress is applied to leaf spring 11. In accordance with this stress, leaf spring 11 is elastically deformed. The movable range of coil unit 2 by corrugated structure portion 10 alone is 1 to 2 mm each in the upper and lower portions. Meanwhile, the movable range of coil unit 2 by damper 12 including leaf spring 11 becomes 5 to 10 mm each in the upper and lower portions. That is to say, when the amplitude exceeds the amplitude limit of corrugated structure portion 10, leaf spring 11 moves, thus enabling large amplitude.

Therefore, even when the amount of amplitude of coil unit 2 is increased in this way, with damper 12, the amplitude is not easily diminished. Consequently, the deterioration of the driving efficiency can be suppressed.

The configuration in which corrugated structure portion 10 is coupled to frame 5 via leaf spring 11 is as mentioned before. That is to say, until the movable range of coil unit 2 becomes large to some extent, the power linearity can be secured by corrugated structure portion 10 formed in a corrugated sheet. Furthermore, when the movable range of coil unit 2 becomes a predetermined amount or more and the linearity cannot be easily secured, the linearity can be compensated by the elasticity of leaf spring 11. Therefore, it is desirable that the elastic modulus of leaf spring 11 is set larger (more rigid) than the elastic modulus of corrugated structure portion 10.

Furthermore, it is desirable that corrugated structure portion 10 and leaf spring 11 have different elastic modulus respectively so that they function independently in accordance with the movable range of coil unit 2. By setting the elastic modulus between corrugated structure portion 10 and leaf spring 11, more specifically, the elastic modulus of coupling portion 13 of corrugated structure portion 10 and leaf spring 11 to be larger (more rigid) than the elastic modulus of corrugated structure portion 10 and the elastic modulus of leaf spring 11, the independence of them can be secured. Coupling portion 13 is a portion where corrugated structure portion 10 and leaf spring 11 are overlapped with each other.

Figure 1B:
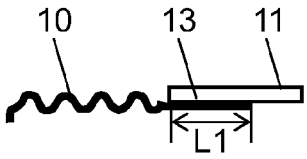
FIG. 1B is a sectional view showing a coupling portion in accordance with the first exemplary embodiment of the present invention.
Figure 1C:
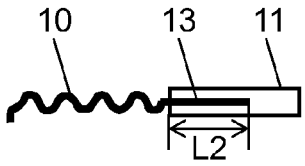
FIG. 1C is a sectional view showing a coupling portion in accordance with the first exemplary embodiment of the present invention.
Figure 1D:
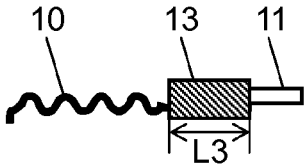
FIG. 1D is a sectional view showing a coupling portion in accordance with the first exemplary embodiment of the present invention.

An example of the method of setting the elastic modulus of coupling portion 13 of corrugated structure portion 10 and leaf spring 11 to be larger than the elastic modulus of corrugated structure portion 10 and leaf spring 11 includes the following method. The method is described with reference to FIGS. 1B to 1D. FIGS. 1B to 1D are sectional views each showing a coupling portion in accordance with the first exemplary embodiment of the present invention. Coupling portion 13 refers to as ranges L1, L2 and L3. For example, as shown in FIG. 1B, as the kinds of adhesives for bonding corrugated structure portion 10 and leaf spring 11 together, hard adhesive such as acrylic adhesive may be used. Alternatively, as shown in FIG. 1C, corrugated structure portion 10 and leaf spring 11 are integrated with each other by insert molding so as to increase the thickness (more rigid) of the portion. Alternatively, as shown in FIG. 1D, a reinforcing material is attached to coupling portion 13.

Furthermore, in order to secure the power linearity of diaphragm 3 that is a sound generation region of a speaker, a composite of corrugated structure portion 10 and leaf spring 11 is optimized. Furthermore, it is desirable to regulate the relation between the composite of corrugated structure portion 10 and leaf spring 11 and edge 4 provided on diaphragm 3.

That is to say, the important point in this relation is how freely diaphragm 3 that is a substantial sound generation source of the speaker can vibrate in the vertical direction, uniformly. When this point is considered, in order to make the most use of the linearity of diaphragm 3, it is desirable that the elastic modulus of edge 4 provided on diaphragm 3 is set to 0.8 to 1.2 times as the elastic modulus of damper 12 that is a composite of corrugated structure portion 10 and leaf spring 11.

Second Exemplary Embodiment

Diaphragm 3, coil unit 2 and corrugated structure portion 10, which are located in a region between edge 4 and leaf spring 11, can be regarded as an integrated rigid body. Therefore, when the distance between edge 4 and leaf spring 11 is increased, the rolling of coil unit 2 can be suppressed and the distortion can be reduced.

Figure 2:
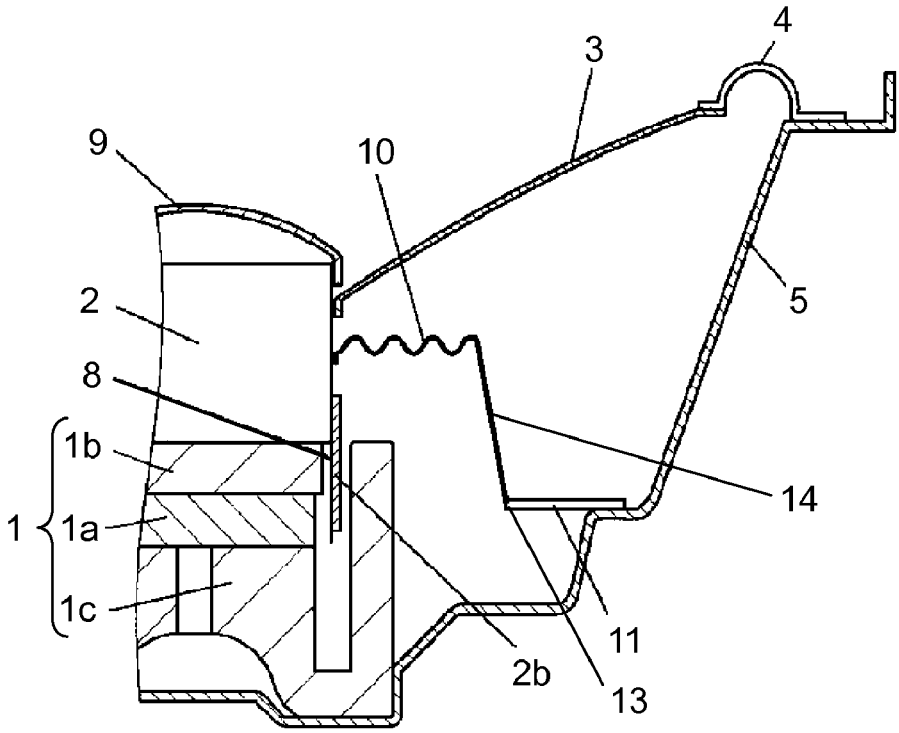
FIG. 2 is a partially cutaway sectional view showing a speaker in accordance with a second exemplary embodiment of the present invention.
Figure 3:
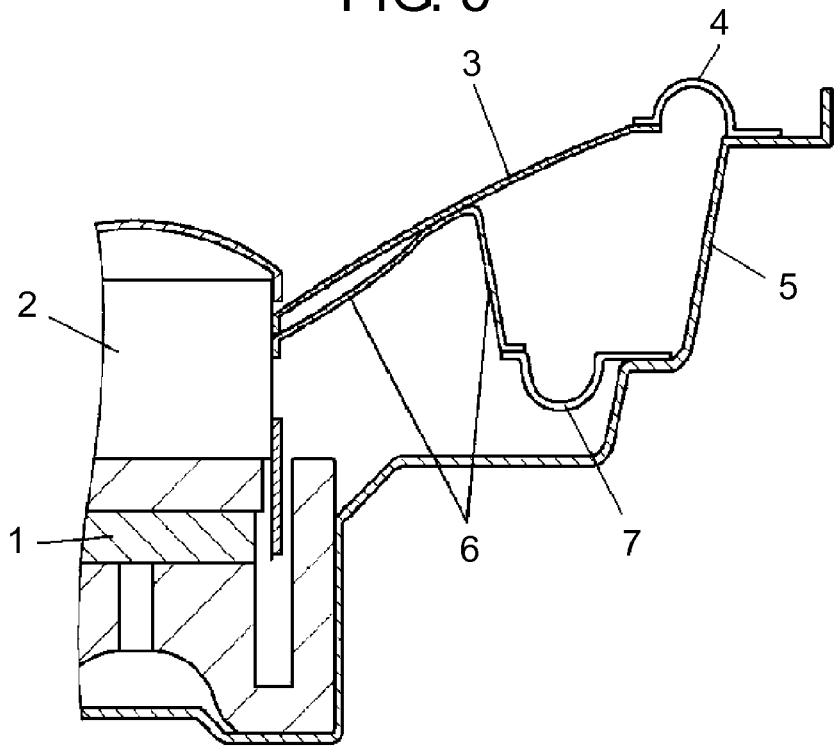
FIG. 3 is a partially cutaway sectional view showing a conventional speaker.

FIG. 2 is a partially cutaway sectional view showing a speaker in accordance with the second exemplary embodiment of the present invention. This speaker is provided with linearly extending portion 14 extending from the outer periphery of the corrugated structure portion 10 to the position at the similar height as that of magnetic gap 8. Linearly extending portion 14 is coupled to leaf spring 11 at coupling portion 13, and leaf spring 11 is coupled to frame 5.

Thus, the distance between edge 4 and leaf spring 11 can be increased as compared with the structure shown in FIG. 1A. As a result, the effect of suppressing the rolling of coil unit 2 can be further improved.

INDUSTRIAL APPLICABILITY

A speaker of the present invention can reduce the distortion of the speaker and improve the driving efficiency. In particular, the speaker of the present invention is useful for a small-sized speaker.

The invention claimed is:

1. A speaker comprising:

a frame:

a magnetic circuit supported by the frame;

a voice coil unit inserted into a magnetic gap provided in the magnetic circuit and capable of moving in the magnetic gap;

a diaphragm coupled to the frame via an edge at its outer peripheral end and coupled to the voice coil unit at its inner peripheral end; and a damper provided at a part that is lower than the diaphragm and nearer to the magnetic circuit and coupled to the frame at its outer peripheral end and to the voice coil unit at its inner peripheral end;

wherein the damper comprises a corrugated structure portion at its inner peripheral side and a leaf spring at its outer peripheral side, and wherein the corrugated structure portion is connected to the frame through the leaf spring.

2. The speaker of claim 1, wherein an elastic modulus of the damper is equal to an elastic modulus of the edge.

3. The speaker of any one of claims 1 and 2, wherein an elastic modulus of the leaf spring is larger than an elastic modulus of the corrugated structure portion.

4. The speaker of any one of claims 1 and 2, wherein an elastic modulus of a coupling portion of the leaf spring and the corrugated structure portion is larger than an elastic modulus of the leaf spring and an elastic modulus of the corrugated structure portion.

5. The speaker of claim 1, wherein a movable range of the voice coil unit is 5 to 10 mm each in an upward and a downward direction.

6. The speaker of claim 1, wherein an elastic modulus of the edge is 0.8 to 1.2 times as much as an elastic modulus of the damper.

7. The speaker of claim 1, wherein the corrugated structure portion consists of a single ring shaped corrugated layer.

8. The speaker of claim 1, wherein the damper consists of the corrugated structure portion at its inner peripheral side and the leaf spring at its outer peripheral side.

9. The speaker of claim 1, wherein the corrugated structure portion comprises a single corrugated layer and the leaf spring comprises a single flat layer.

10. The speaker of claim 1, wherein the leaf spring comprises an inwardly projecting spring.

11. The speaker of claim 1, wherein the corrugated structure portion ends at its outer peripheral end where it is coupled to an inner periphery of the leaf spring.

12. A speaker comprising:

a frame:

a magnetic circuit supported by the frame;

a voice coil unit inserted into a magnetic gap provided in the magnetic circuit and capable of moving in the magnetic gap;

a diaphragm coupled to the frame via an edge at its outer peripheral end and coupled to the voice coil unit at its inner peripheral end;

a damper provided at a part that is lower than the diaphragm and nearer to the magnetic circuit and coupled to the frame at its outer peripheral end and to the voice coil unit at its inner peripheral end, the damper comprises a corrugated structure portion at its inner peripheral side and a leaf spring at its outer peripheral side; and a linearly extending portion extending from an outer periphery of the corrugated structure portion to a position at similar height as that of the magnetic gap, wherein the linearly extending portion is coupled to the leaf spring.

13. A speaker comprising:

a frame:

a magnetic circuit supported by the frame;

a voice coil unit inserted into a magnetic gap provided in the magnetic circuit and capable of moving in the magnetic gap;

a diaphragm coupled to the frame via an edge at its outer peripheral end and coupled to the voice coil unit at its inner peripheral end;

a damper provided at a part that is lower than the diaphragm and nearer to the magnetic circuit and coupled to the frame at its outer peripheral end and to the voice coil unit at its inner peripheral end, the damper comprises a corrugated structure portion at its inner peripheral side and a leaf spring at its outer peripheral side; and a linearly extending portion extending from an outer periphery of the corrugated structure portion to a position at similar height as that of the magnetic gap, wherein the linearly extending portion is coupled to the leaf spring, wherein an elastic modulus of the damper is equal to an elastic modulus of the edge.

* * * * *